US011293370B1

(12) United States Patent
Puckett et al.

(10) Patent No.: US 11,293,370 B1
(45) Date of Patent: Apr. 5, 2022

(54) METHOD AND SYSTEM FOR VALVE POSITION MONITORING

(71) Applicant: Caterpillar Inc., Peoria, IL (US)

(72) Inventors: Daniel R. Puckett, Peoria, IL (US); Andrew O. Marrack, Peoria, IL (US); Michael E. Sattler, Eureka, IL (US); Mitchell B. Juchems, Tremont, IL (US)

(73) Assignee: Caterpillar Inc., Peoria, IL (US)

( * ) Notice: Subject to any disclaimer, the term of this patent is extended or adjusted under 35 U.S.C. 154(b) by 13 days.

(21) Appl. No.: 16/953,841

(22) Filed: Nov. 20, 2020

(51) Int. Cl.
*F02D 41/30* (2006.01)
*F02D 41/22* (2006.01)
*F02D 41/20* (2006.01)

(52) U.S. Cl.
CPC ..... *F02D 41/30* (2013.01); *F02D 41/20* (2013.01); *F02D 41/22* (2013.01); *F02D 2041/2055* (2013.01); *F02D 2041/2058* (2013.01); *F02D 2041/224* (2013.01); *F02D 2200/101* (2013.01)

(58) Field of Classification Search
CPC ..... F02D 41/20; F02D 41/22; F02D 41/30; F02D 41/34; F02D 41/345; F02D 41/40; F02D 41/401; F02D 2041/224; F02D 2041/2055; F02D 2041/2058; F02M 47/00; F02M 47/02; F02M 47/027; F02M 51/00; F02M 51/06; F02M 51/061
USPC ..... 701/103, 105; 73/114.45, 114.47, 73/114.49; 123/445, 472
See application file for complete search history.

(56) References Cited

U.S. PATENT DOCUMENTS

| | | | | |
|---|---|---|---|---|
| 4,238,813 | A | 12/1980 | Carp et al. | |
| 2002/0166541 | A1 | 11/2002 | Yamakado et al. | |
| 2003/0120418 | A1* | 6/2003 | Treichel | F02D 41/345 701/105 |
| 2008/0092853 | A1* | 4/2008 | Harcombe | F02M 59/366 123/472 |
| 2010/0096473 | A1* | 4/2010 | Coldren | F02M 63/0029 239/90 |
| 2018/0328308 | A1* | 11/2018 | Iwano | F02M 59/366 |

* cited by examiner

*Primary Examiner* — Robert A Werner
(74) *Attorney, Agent, or Firm* — Bookoff McAndrews PLLC

(57) ABSTRACT

A method for controlling a fuel injector of an engine system includes applying a pull-in current to close a spill valve of the fuel injector and detecting a timing at which the spill valve closes. The method also includes adjusting at least one of an amplitude of the pull-in current, a duration of the pull-in current, or a timing of a start of an application of the pull-in current based on the detected timing of the closing of the spill valve.

20 Claims, 5 Drawing Sheets

METHOD AND SYSTEM FOR VALVE POSITION MONITORING

TECHNICAL FIELD

The present disclosure relates generally to systems for internal combustion engines, and more particularly, to methods and systems for valve movement detection in a fuel injector of an internal combustion engine system.

BACKGROUND

Internal combustion engines include electronic controllers that monitor and control multiple aspects of the operation of the engine, including the timing and quantity of fuel injection. In order to accurately control fuel injection, electronic controllers are programmed in a manner that reflects initial performance characteristics of the fuel injector which affect the responsiveness of the fuel injector's components during operation of the engine. This initial programming may provide control over fuel injection parameters, such as timing and quantity. However, this programming may be inaccurate for fuel injectors that, due to manufacturing tolerances, deviate from the expected initial performance characteristics. Even when a fuel injector closely matches expected initial characteristics, the responsiveness of the fuel injector changes as engine conditions change. For example, performance of a fuel injector changes over time due to wear of the fuel injector. In order to compensate for changes in fuel injector performance, or to evaluate the characteristics of a newly-installed fuel injector, some engine systems include a controller that monitors the position of one or more electronically-controlled injector valves. These control units may be unable, however, to detect the position of the valve while current is being applied to drive the valve to a particular position, and thus may be unable to perform a complete analysis of the fuel injector's operation. Moreover, these electronic controllers may be unable to adapt control of fuel injectors according to the actual time that a fuel injector valve reaches an actuated position, such as a position associated with fuel injection.

A fuel injector and injector control circuit is disclosed in U.S. Patent Application No. 2002/0166541 A1 (the '541 publication) to Yamakado et al. The fuel injector described in the '541 publication includes a control coil and a hold coil that generate a force that drives a valve within the injector. A signal processing circuit manages timing for stopping or slowing current by stopping current after a preset time, or after reaching a preset current. While the fuel injector described in the '541 publication may be useful in some circumstances, it may be unable to detect an actual time at which a valve reaches an actuated position. Thus, the fuel injector described in the '541 publication may be unable to compensate for changes in conditions that affect the actuation of a fuel injector valve, or take into account conditions that differ from the initial characteristics used to calculate the preset time or current.

The disclosed method and system may solve one or more of the problems set forth above and/or other problems in the art. The scope of the current disclosure, however, is defined by the attached claims, and not by the ability to solve any specific problem.

SUMMARY

In one aspect, a method for controlling a fuel injector of an engine system may include applying a pull-in current to close a spill valve of the fuel injector and detecting a timing at which the spill valve closes. The method may also include adjusting at least one of an amplitude of the pull-in current, a duration of the pull-in current, or a timing of a start of an application of the pull-in current based on the detected timing of the closing of the spill valve.

In another aspect, a fuel injection method for controlling a fuel injector of an engine system may include applying current having a first current level to a solenoid to actuate a valve from a resting position toward an actuated position and detecting a timing at which the valve reaches the actuated position, while applying current to the solenoid, based on a change in a second current level. The method may also include adjusting at least one of an amplitude of a pull-in current, a duration of the pull-in current, or a timing of a start of an application of the pull-in current based on the detected timing.

In yet another aspect, a fuel injection control system may include at least one power source, a fuel injector including a spill valve, the spill valve being biased towards an open position and including a spill valve solenoid, and a controller. The controller may be configured to apply a pull-in current to close the spill valve of the fuel injector, detect a timing at which the spill valve closes, and adjust at least one of an amplitude of a pull-in current, a duration of the pull-in current, or a timing of a start of an application of the pull-in current based on the detected timing of the closing of the spill valve.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
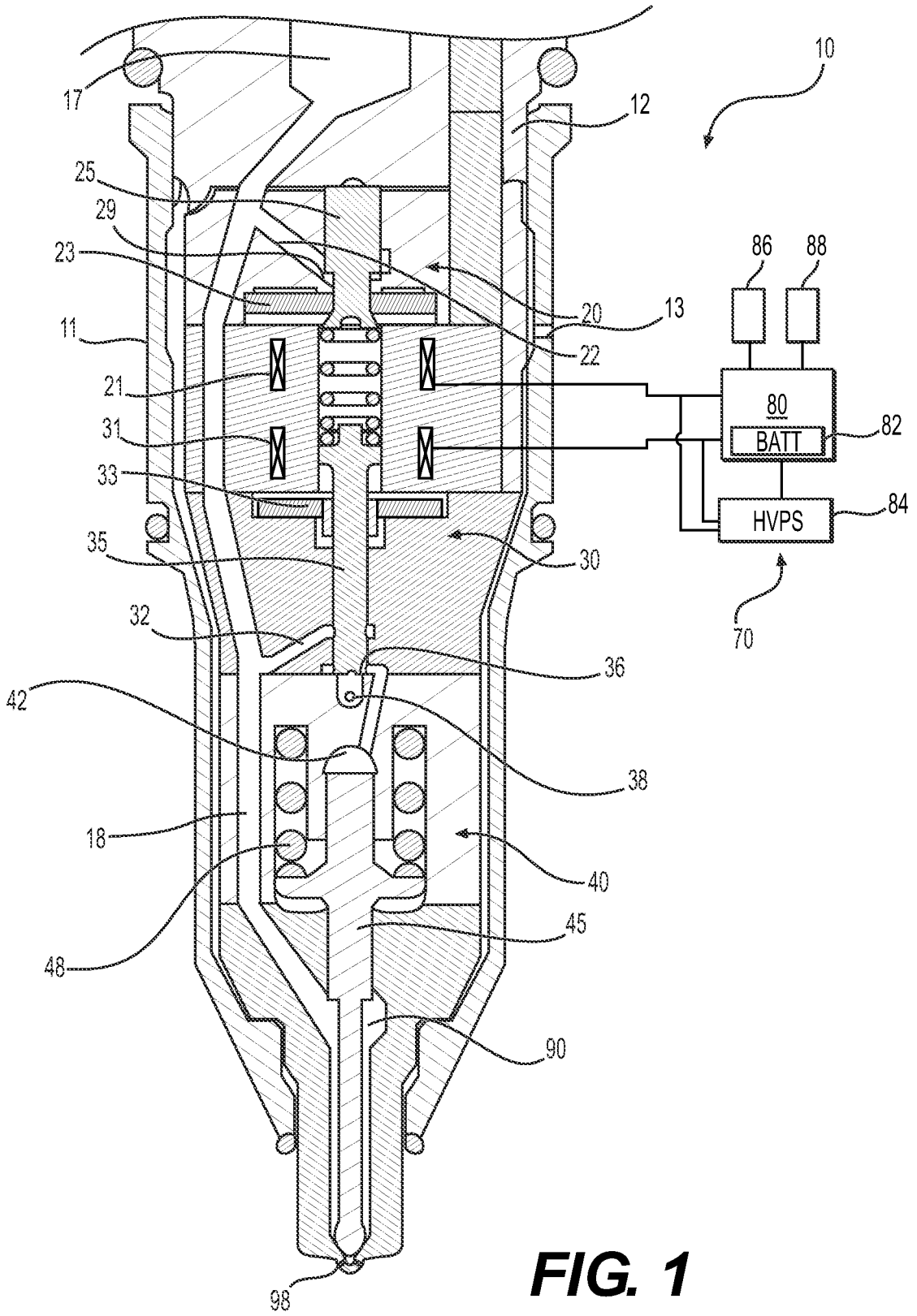
FIG. 1 is a partially schematic cross-sectional view of a fuel injector in a fuel injection system, according to aspects of the present disclosure.

FIG. 1 is a diagram illustrating a fuel injection system 10 according to an aspect of the present disclosure, including a cross-sectional view of a fuel injector 12. Fuel injection system 10 may be a component of an internal combustion engine system and may include fuel injector 12 and a control system 70 including one or more power sources, such as a high-voltage power source (HVPS) 84 and a battery 82, and a controller, such as an electronic control module (ECM) 80. Fuel injector 12 may be a mechanically-actuated electronically-controlled unit injector including an injector body 11 housing one or more valves for injecting fuel, and a series of passages for supplying, returning, and injecting fuel. A fuel reservoir or pressure chamber 17 may receive fuel from a fuel source. Fuel within pressure chamber 17 may be pressurized by a cam-actuated piston (not shown) to provide pressurized fuel to a check valve 40. In addition to check valve 40, fuel injector 12 may include one or more electronically-controlled valves, such as a spill valve 20 and a control valve, such as direct-operated control (DOC) valve 30.

Spill valve 20 may be a normally-open valve that includes a spill solenoid 21, spill armature 23, spill valve member 25, and a spill valve seat 29. When spill valve 20 is in a resting or open position (the position illustrated in FIG. 1), a spill valve member 25 may be positioned away from seat 29 to permit communication between a spill passage 22 and a fuel return passage 13, reducing pressure and allowing fuel to drain from injector 12. When actuated or closed, spill valve member 25 may rest on spill valve seat 29 and prevent fuel from entering fuel return passage 13. This actuated position of spill valve 20 may be associated with the injection of fuel.

DOC valve 30 may be a normally-closed valve that includes a DOC solenoid 31, a DOC armature 33, a DOC valve member 35, and a DOC valve seat 36. In a first position of DOC valve 30 illustrated in FIG. 1, referred to as a resting position or a closed position herein, DOC valve member 35 may be positioned so as to permit communication between a control chamber 42 and pressure connection passage 32. When in this closed position, DOC valve member 35 may rest on DOC valve seat 36 and block communication between control chamber 42 and a low-pressure fuel passage pressure connection passage 38, placing control chamber 42 in a pressurized condition that prevents motion of check valve member 45. DOC valve member 35 may be biased toward this closed position by a spring member. In a second position, referred to as an actuated position or an open position herein, DOC valve member 35 may block communication between control chamber 42 and pressure fuel channel 32, and may permit communication between control chamber 42 and low-pressure passage 38, releasing pressure in control chamber 42. The actuated or open position of DOC valve 30 may be associated with the injection of fuel.

Check valve 40 may be a one-way needle valve including a check valve member 45 that, when in a closed position shown in FIG. 1, blocks communication between a check valve chamber 90 and injection orifices 98. When in an open position, communication may be permitted between check valve chamber 90 and injection orifices 98, allowing fuel to be injected. A spring member 48 may bias check valve member 45 toward the closed position. Additionally, check valve member 45 may be held in the closed position when control chamber 42 is in communication with pressure connection passage 32. Needle valve member 45 may be configured to move from this closed position to an open position when DOC valve 30 is in the open or actuated position. For example, when spill valve 20 is closed and DOC valve 30 is open, control chamber 42 may be at a lower pressure compared to pressure within check valve chamber 90, thereby allowing pressurized fuel in check valve chamber 90 to act against a biasing force of spring member 48 and inject fuel through orifices 98.

Control system 70 may be configured to receive various sensed inputs and generate commands or other signals to control the operation of a plurality of fuel injectors 12 of fuel injection system 10. Control system 70 may include ECM 80, battery 82, HVPS 84, and one or more sensors, such as a temperature sensor 86 configured to detect a temperature associated with injector 12 and/or an environment in which injector 12 operates, and an engine speed sensor 88 configured to measure an operational speed of an internal combustion engine associated with a plurality of fuel injectors 12.

Figure 4:
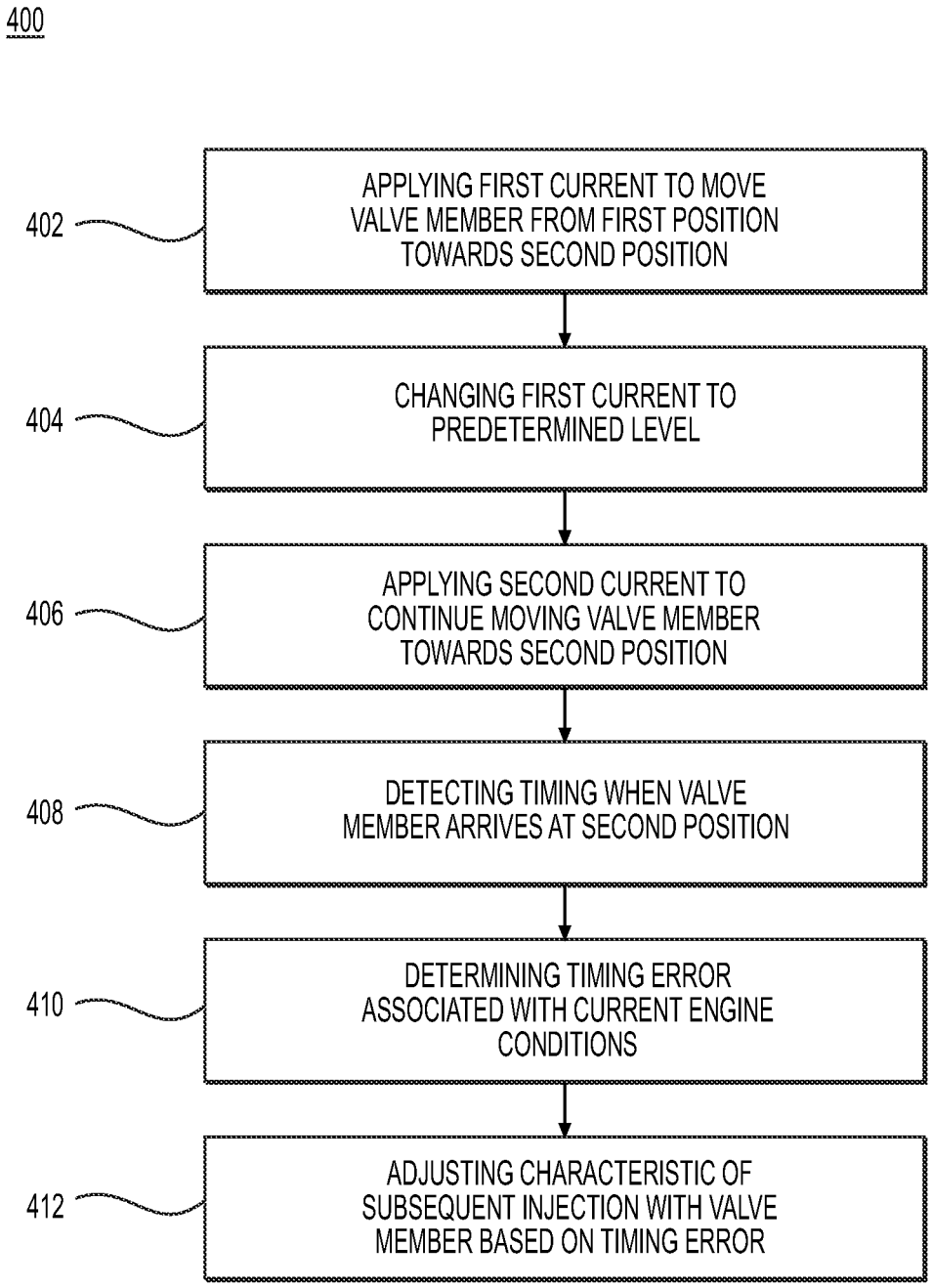
FIG. 4 is a flowchart of a method for controlling a fuel injector of an engine system, according to aspects of the present disclosure.

ECM 80 may include a single microprocessor or multiple microprocessors that receive inputs and issue control signals, including the application of electrical energy to solenoids 21 and 31. ECM 80 may contain a power source (e.g., battery 82) in electrical communication with solenoids 21 and 31, and may output commands to separate control circuitry, including circuitry for a HVPS 84 configured to boost a voltage of electrical energy applied to solenoids 21 and 31. While HVPS 84 is shown outside of ECM 80, HVPS 84 may instead be implemented within ECM 80. In some embodiments, as shown in FIG. 1, ECM 80 may be configured to control the application of energy to solenoids 21 and 31 via battery 82 and HVPS 84. ECM 80 may issue commands to selectively energize solenoids 21 and 31 with electrical power from battery 82 and/or HVPS 84, and de-energize solenoids 21 and 31 to control a rate of decay of electrical energy stored by solenoids 21 and 31. ECM 80 may include a memory, a secondary storage device, a processor, such as a central processing unit, or any other means for accomplishing a task consistent with the present disclosure. The memory or secondary storage device associated with ECM 80 may store data and software to allow ECM 80 to perform its functions, including the functions described below with respect to method 400 (FIG. 4). In particular, such data and software in memory or secondary storage device(s) may allow ECM 80 to perform any of the valve arrival timing, signal analyses, and adaptive injector control functions described herein. Numerous commercially available microprocessors can be configured to perform the functions of ECM 80. Various other known circuits may be associated with ECM 80, including signal-conditioning circuitry, communication circuitry, and other appropriate circuitry.

Figure 2:
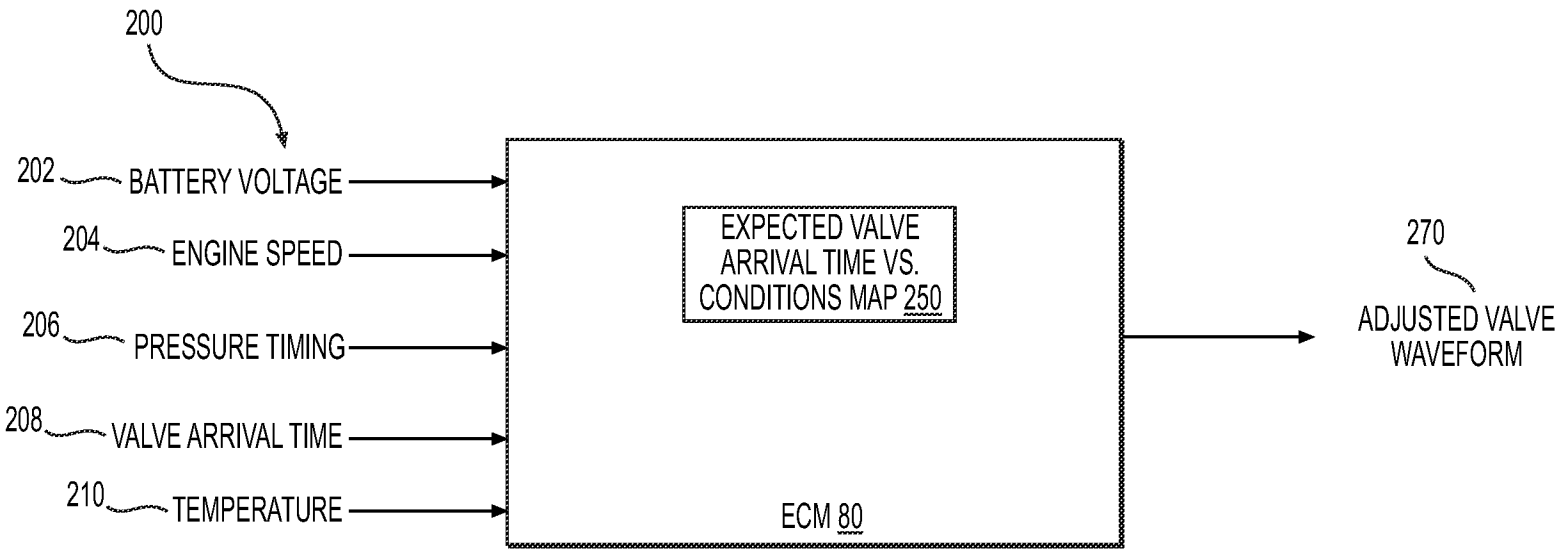
FIG. 2 is a block diagram of an exemplary engine control module of the fuel injection system of FIG. 1.
Figure 3:
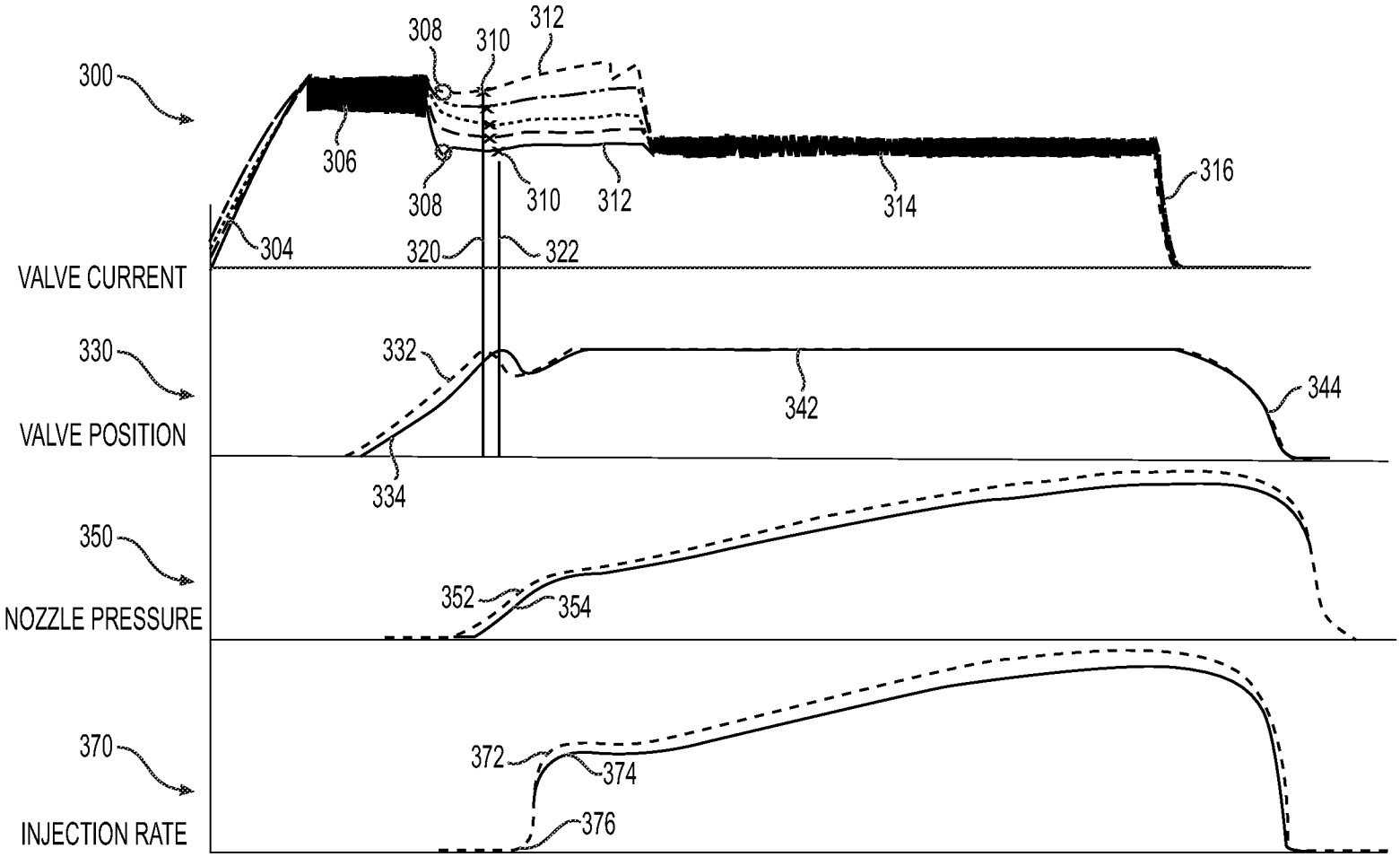
FIG. 3 is a chart illustrating an exemplary operation of the fuel injection system of FIG. 1.

FIG. 2 illustrates an exemplary configuration of ECM 80. In at least some aspects, ECM 80 may receive a plurality of inputs 200 that each correspond to one or more engine conditions. Inputs 200 may include one or more detected values and one or more values that are calculated and/or stored by ECM 80 or by an external control unit. As a first input 200, ECM 80 may receive a battery voltage 202 indicative of a voltage of battery 82. This value may be a sensed or stored value in ECM 80 and is representative of the voltage of battery 82. An engine speed input 204 may be indicative of a current operating speed of an internal combustion engine detected by, for example, engine speed sensor 88. A pressure timing 206 may represent a desired timing at which pressurization of fuel in fuel injector 12 begins, such as a timing at which nozzle pressure 354 begins to increase, as shown in FIG. 3 and as described below. This desired pressure timing 206 may be calculated based on engine parameters such as engine speed 204, a requested engine output, or others, and may be determined by accessing a map with ECM 80. A valve arrival time 208 may correspond to a detected arrival time at which a valve reaches an actuated position. Valve arrival time 208 may represent, for example, an actual or detected timing at which spill valve 20 reaches a closed state where spill valve member 25 contacts spill valve seat 29. Temperature 210 may correspond to a temperature sensed by temperature sensor 86 and may represent a temperature of fuel injector 12 itself or of an environment of fuel injector 12, such as a temperature within an engine compartment.

ECM 80 may include a map 250 that associates a plurality of expected spill valve arrival times with various engine conditions. In some aspects, map 250 may allow ECM 80 to retrieve an expected or desired arrival time at which spill valve 20 arrives for a set of map inputs. Sets of map inputs may correspond to engine conditions, such as: battery voltage 202, engine speed 204, and pressure timing 206. The expected arrival time output by map 250 may correspond to a desired timing at which spill valve 20 closes (e.g., a timing at which spill valve member 25 reaches spill valve seat 29) for a particular set of engine conditions. One or more values of the detected valve arrival time 208 for spill valve 20 may be stored in map 250, together with engine conditions present during valve arrival time 208. ECM 80 may be configured to compare the detected spill valve arrival time 208 to the expected spill valve arrival time output by map 250 in order to calculate a difference, or error, between these two values. ECM 80 may further be configured to adjust one or more characteristics of the electrical energy provided to solenoids of valve 20 based on this error, as described below, and output an adjusted valve waveform 270 in the form of an adjusted amplitude, duration, or timing, for current applied to in a subsequent injection. Adjusted valve waveform 270 may, in at least some aspects, be applied to adjust a timing at which current begins to be applied for closing spill valve 20.

INDUSTRIAL APPLICABILITY

Fuel injection system 10 may be used in conjunction with any appropriate machine, vehicle, or other device or system that includes an internal combustion engine having one or more fuel injectors with at least one electronically-controlled valve. In particular, fuel injection system 10 may be used in any internal combustion engine system in which it is desirable to detect a timing at which an electronically-controlled valve component, such as a solenoid-actuated valve, reaches an actuated position.

FIG. 3 is a chart illustrating exemplary plots of current waveforms, valve positions, nozzle pressures, and injection rates, with respect to time. A first plot in FIG. 3 includes five exemplary current waveforms 300, each current waveform 300 representing a different voltage applied by battery 82 to spill valve solenoid 21. Each waveform may include a current ramp-up 304, pull-in target current 306, pre-measurement target current 308, local minimum current 310, measurement current 312, hold-in current 314, and current ramp-down 316.

A second plot illustrates a pair of valve positions 330 with respect to time, each plot corresponding respectively to two current waveforms 300. In the example shown in FIG. 3, the solid line represents a valve motion (e.g., of spill valve member 25) that matches a desired valve movement 334 having a valve arrival time 322 that corresponds to an expected or desired valve arrival time stored in map 250 for current engine conditions. The dashed-line plot of valve position chart 330 represents an exemplary valve motion 332 at which the valve reaches an actuated position at actual valve arrival time 320. A difference between actual valve arrival valve arrival time 320 and desired valve arrival time 322 may be represent a timing error. Following the valve arrival, valve member 25 may be held in a closed position 342 for a desired period of time, before beginning a return transition 344 to an open position.

A third plot illustrates exemplary nozzle pressures 350, including an actual nozzle pressure 352 corresponding to actual valve movement 332 and a desired nozzle pressure 354 that corresponds to desired valve movement 334. Each nozzle pressure 352, 354 may build during a timing when spill valve 20 is closed, and may represent a pressure of fuel within fuel injector 12, such as fuel within check valve chamber 90, for example.

A fourth plot of FIG. 3 illustrates exemplary injection rates 370, including an actual injection rate 372 and a desired injection rate 374. While each injection rate 372 and 374 may begin at approximately the same injection starting timing 376, due to the differences between actual and desired nozzle pressures 352 and 354, actual injection rate 372 may inject more fuel than desired.

FIG. 4 is a flowchart illustrating a method 400 for controlling one or more fuel injectors 12 of an engine system which may include fuel injection system 10. Method 400 may be performed repeatedly during the operation of an engine over time in order to gradually adjust commands that are issued to one or more valves of injector 12 in order to compensate for changing engine conditions, which may include environmental conditions such as engine temperature, and changing conditions of the engine itself, such as changes in the performance of the injector due to wear. Method 400 may, for example, include adjusting one or more aspects of the current applied by battery 82, HVPS 84, or both, based on a detected timing at which a valve arrives at an actuated position. While method 400 will be described with respect to spill valve 20, as understood, method 400 may be applied to DOC valve 30, or other types of electronically-controlled valves. Method 400 may allow fuel injection system 10 to trim current applied to one or more valves of injector 12 so as to inject a desired amount of fuel.

In a step 402, a first current may be applied to a solenoid 21, generating a magnetic force that pulls armature 23 and spill valve member 25 towards a closed position, against the force of a spring member. This first current may include applying a boosted voltage, from HVPS 84 or another power source, such that current waveform includes a current ramp-up 304 at a timing determined by ECM 80, as shown in FIG. 3. When a predetermined target current has been reached, the boosted voltage may be periodically chopped, forming a series of regularly repeating fluctuations above and below the predetermined target current, as represented by pull-in target current 306 (FIG. 3). Chopping voltage may include discontinuing the application of electrical energy when the current reaches a predetermined maximum value, and re-applying electrical energy when the current reaches a predetermined minimum value, such that the amount of current regularly increases and decreases between the maximum and minimum values.

In a step 404, at a predetermined timing, the first current may be changed to a predetermined level, such as pre-measurement target current 308 (FIG. 3). Pre-measurement target current 308 may be determined based on battery voltage 202 and temperature 210. In some injections, pre-measurement target current 308 may be less than the pull-in target current 306. In these injections, the current may be reduced to reach pre-measurement target current 308, either via a gradual (e.g., free-wheeling) reduction in current, or by driving down the current. In other injections, pre-measurement target current 308 may be greater than pull-in target current 306. In these injections, a boosted voltage may be applied to increase the current above pull-in target current 306.

Once pre-measurement target current 308 is reached, a second current may be applied to solenoid 21. The second current may be applied from a different source (e.g., a non-chopped source, such as battery 82). Electrical energy from battery 82 may be non-chopped, for example, because electrical energy may be supplied from battery 82 without repeatedly discontinuing and resuming the application of this electrical energy. An exemplary second current, measurement current 312, may be applied during a window of time within which valve member 25 is expected to initially arrive at the closed position. In the example shown in FIG. 3, measurement current 312 may be applied without chopping. During this window of time, a step 408 may be performed by ECM 80 to detect a timing when valve member 25 arrives at the actuated position. If desired, this window may begin after a predetermined delay after pre-measurement target current 308. ECM 80 may detect this arrival timing by searching for a predetermined pattern in measurement current 312. The predetermined pattern may correspond to a local current minimum that is detected while measurement current 312 is applied. This local minimum value, which is indicated with an "x" in FIG. 3, may allow ECM 80 to determine a period of time that elapsed from the time current was initially applied (e.g., at initiation of current ramp-up 304). In some aspects, a comparator circuit may facilitate the detection of the valve arrival time according to the presence of a local minimum current.

A value of the actual valve arrival time 208 detected by ECM 80 may be stored or logged in ECM 80. ECM 80 may also store a set of current engines conditions associated with valve arrival time 208, including one or more of battery voltage 202, engine speed 204, and pressure timing 206.

Step 410 may include determining, with ECM 80, a timing error associated with current engine conditions. This may be performed by comparing the detected or actual valve arrival time 208 to an expected valve arrival time. The actual valve arrival time may correspond to a value stored in a memory of ECM 80 that is representative of a single detected valve arrival time 208, or a filtered and/or averaged group of valve arrival times 208 associated with the same or similar engine conditions, that were stored or logged in ECM 80. This error may represent a difference between an actual valve arrival time, such as valve arrival time 208 represented by arrival time 320 in FIG. 3, and an expected valve arrival time stored in a memory associated with ECM 80, such as an expected valve arrival time output from map 250, represented by arrival time 322. In order to avoid the influence of outliers in a plurality of valve time arrival measurements, ECM 80 may apply a filter, or average a plurality of different valve arrival time measurements associated with the same or similar engine conditions, and compare this filtered and/or averaged valve arrival time for determining the error. Values of these different valve arrival time measurements may be stored in a memory associated with ECM 80, as described above.

If desired, step 410 may include comparing a value of the timing error to one or more predetermined thresholds in order to perform prognostic and/or diagnostic functions for injector 12. For example, the timing error may be indicative of an amount of useful life remaining in fuel injector 12, based on wear experienced by spill valve 20 over time. This information may be output by ECM 80 as a prognostic indicator that is indicative of the remaining useful life or wear accumulated in injector 12. Additionally or alternatively, ECM 80 may determine a failure state of fuel injector 12 exists when the timing error exceeds a predetermined threshold. When this occurs, ECM 80 may output a diagnostic indicator that is indicative of a failure condition of injector 12.

Step 412 may include, in one or more subsequent injections, adjusting one or more parameters for controlling fuel injector 12. For example, ECM 80 may adjust an amplitude of pull-in current, a duration of pull-in current, a timing at which pull-in current begins to be applied, or any combination thereof (FIG. 3). Adjusting an amplitude of pull-in current may include increasing or decreasing one or more of pull-in target current 306 and holding current 314 for one or more subsequent injections. Adjusting a duration of pull-in current may include increasing or decreasing one or more of a duration of pull-in target current 306, a duration of holding current 314, a total duration during which current is applied to spill valve solenoid 21 during an injection, a duration that current is applied following the valve arrival time, or any combination thereof. Adjusting a timing at which pull-in current begins to be applied may include changing a timing at which a power source, such as HVPS 84, begins applying current to spill valve solenoid 21, represented by an initial increase in current ramp-up 304. When adjusted in this manner, the actual valve arrival time 320 may substantially correspond to desired valve arrival time 322, eliminating the timing error of the spill valve.

Adjustments may also be performed based on at least one of a battery voltage 202 of the engine system including fuel injection system 10, engine speed 204, or desired start of pressurization timing 206, as engine conditions change over time. For example, changes in one or more of these values may cause map 250 to determine an updated expected spill valve arrival time from which the timing error may be calculated for one or more subsequent injections.

Figure 5:
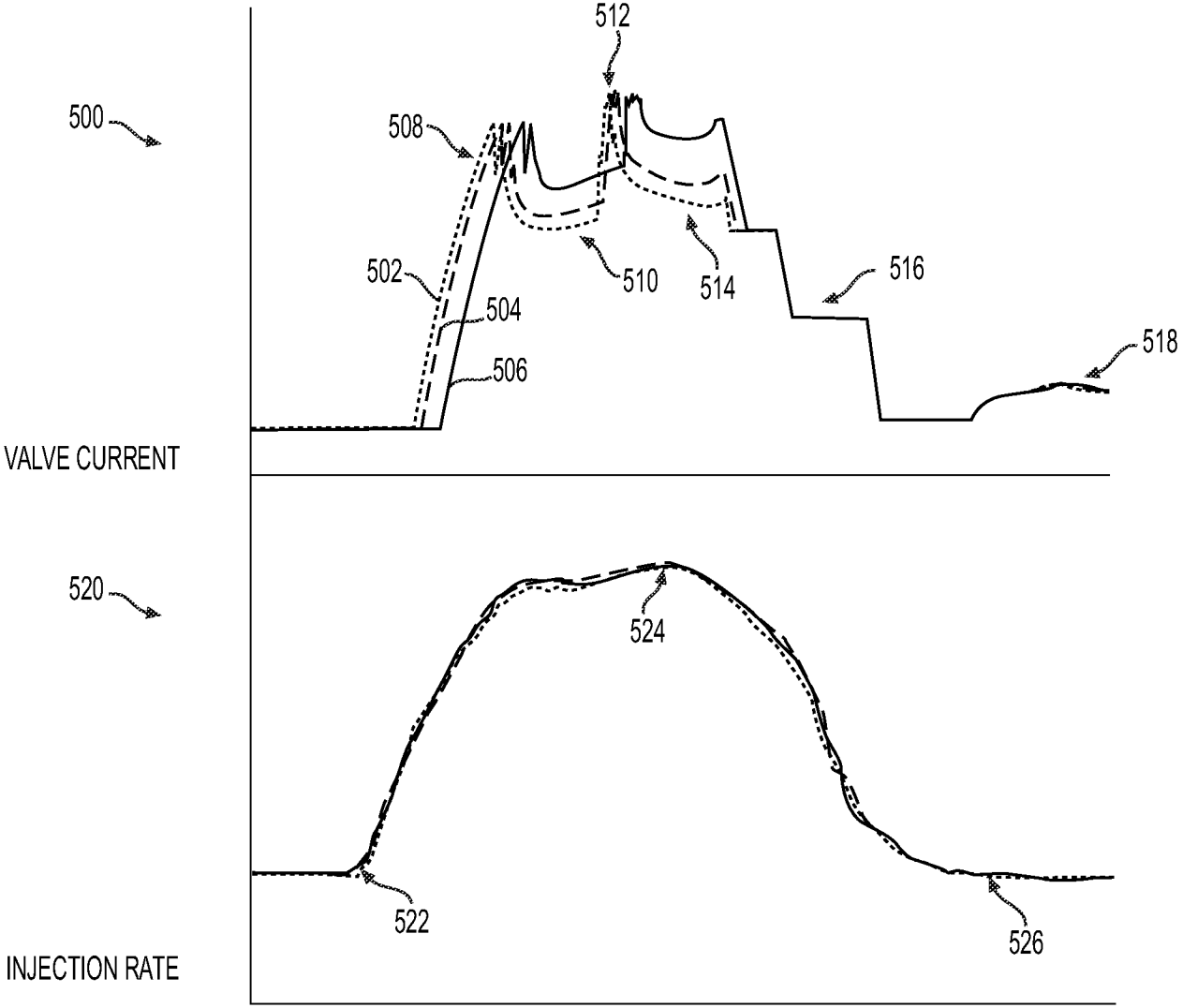
FIG. 5 is a chart illustrating exemplary operations of the fuel injection system of FIG. 1 with power sources having different voltages.

FIG. 5 is a chart illustrating a plurality of injection events in which different voltages are applied to spill solenoid 21. These different voltages may be different voltages of battery 82. A first plot of FIG. 5 illustrates a plurality of exemplary current waveforms 500, each waveform representing the use of an energy source (e.g., battery 82) having a different voltage. For example, a first waveform in dotted lines represents use of a first battery voltage, a second waveform in dashed lines represents use of a second battery voltage, and a third waveform in solid lines represents use of a third battery voltage, as described below.

The valve current waveforms illustrated in FIG. 5 may include, for example, a current ramp-up, represented by individually-labelled first 502, second 504, and third 506 current ramp ups, a pull-in target current 508, a first battery current 510, an optional boosted current 512, a measurement current 514, and keep-in and/or hold-in currents 516. Pull-in target current 508, first battery current 510, and boosted current 512 may be applied instead of pull-in target current 306, and may perform similar functions. Thus, one or more of the pull-in target current 508, first battery current 510, and boosted current 512 may correspond to a first current. It may be useful to apply battery current 510 in current waveforms 500, to conserve electrical energy of system 10. A current induced by the motion of the valve returning to a resting position is represented by free-wheeling current 518 in FIG. 5.

The different current levels of first battery current 510 and measurement current 514, which may correspond to a second battery current, represent the currents applied by batteries 82 having different voltages, with lower current corresponding to batteries having lower voltages. Thus, the solid line waveform represents a battery voltage that is the highest of three exemplary voltages, while the dotted line waveform represents a battery voltage that is the lowest of the three voltages.

Each of these waveforms may represent an example of an adjusted valve waveform 270 that is based on one or more previous valve arrival time measurements. As described above, an amplitude of pull-in current, such as one or more of currents 504-514, a duration of the pull-in current, and/or a timing of a start of the application of the pull-in current may be adjusted based on one or more timing errors from previous injections. By making such adjustments, it may be possible to achieve consistent desired injection qualities, as represented by the exemplary injection rates 520 in the second plot of FIG. 5.

The lower waveforms in FIG. 5 illustrate exemplary injection rates 520 that correspond to each of the three valve current waveforms 500 in the first chart of this figure, when ECM 80 performs the above-described adjustments. As can be seen in FIG. 5, while the timing of the start of the application of each pull-in current is different, the timing of the start of injection 522, the maximum injection quantity 524, and a timing of the end of injection 526 are approximately the same. Thus, by making the above-described adjustments, it may be possible to inject a desired amount of fuel, while employing a power source with a reduced voltage.

In some fuel injectors, it is necessary to provide a controller with information regarding characteristics of the fuel injector in order for the injector to be controlled as desired. However, changing environmental factors, changing power requirements, or both, may have at least some effect on the operation of the injector. By detecting the arrival time of a valve, in particular, during the application of current to a solenoid for the valve, it may be possible to generate commands for precisely controlling the injector. These commands may be adjusted, for example, to change a characteristic of spill valve current, such as the timing of the start of spill valve current, to improve control over start of injection pressure. This improved control over start of injection pressure may be achieved by accurate control over spill valve arrival timing. Achieving a desired start of injection pressure may result, for example, in improved control over a start of injection timing and control over an amount of fuel delivered by the injector, which can be useful for improving aspects of engine operation. By detecting the arrival time of a valve, it may therefore be possible to reduce an amount of fuel injected to a desired quantity, and thereby improve emissions performance and reduce the quantity and/or opacity of smoke produced by the engine, for example. Additionally, it may be possible to reduce the power requirements of a system for controlling the fuel injector. Finally, in at least some configurations, detection of arrival time may reduce or avoid the need to pre-program the controller with information for the fuel injector when a new injector is installed.

It will be apparent to those skilled in the art that various modifications and variations can be made to the disclosed method and system without departing from the scope of the disclosure. Other embodiments of the method and system will be apparent to those skilled in the art from consideration of the specification and practice of the apparatus and system disclosed herein. It is intended that the specification and examples be considered as exemplary only, with a true scope of the disclosure being indicated by the following claims and their equivalents.

What is claimed is:

1. A method for controlling a fuel injector of an engine system, the method comprising:

applying a pull-in current to close a spill valve of the fuel injector;

detecting a timing at which the spill valve closes while supplying energy with a battery; and adjusting at least one of an amplitude of the pull-in current, a duration of the pull-in current, or a timing of a start of an application of the pull-in current based on the detected timing of the closing of the spill valve.

2. The method of claim 1, wherein the adjusting is further based on at least one of a battery voltage of the engine system, an engine speed of the engine system, or a desired start of pressurization timing of the fuel injector.

3. The method of claim 1, further including associating the detected timing of the closing of the spill valve with at least one engine condition including a battery voltage of the engine system, an engine speed of the engine system, or a desired start of pressurization timing of the fuel injector.

4. The method of claim 3, further including storing a value indicative of the closing of the spill valve and the associated engine condition.

5. The method of claim 4, further including comparing the stored value to a desired value and outputting at least one of a prognostic indicator or a diagnostic indicator based on the comparison.

6. The method of claim 1, wherein the detected timing of the closing of the spill valve corresponds to a drop in current followed by an increase in current.

7. The method of claim 1, wherein the pull-in current is applied as a chopped current for a first period of time and as a non-chopped current applied with the battery during a second period of time.

8. The method of claim 7, wherein the timing at which the spill valve closes occurs during the second period of time.

9. A fuel injection method for controlling a fuel injector of an engine system, comprising:

applying current having a first current level to a solenoid to actuate a valve from a resting position toward an actuated position;

detecting a timing at which the valve reaches the actuated position, while applying energy to continue applying current to the solenoid, based on a change in a level of the current applied to the solenoid; and adjusting at least one of an amplitude of a pull-in current, a duration of the pull-in current, or a timing of a start of an application of the pull-in current based on the detected timing.

10. The method of claim 9, further including changing an amount of current from the first current level to a predetermined current level before the timing at which the valve reaches the actuated position.

11. The method of claim 10, wherein the valve reaches the actuated position while applying energy from a battery to apply current to the solenoid without chopping the current.

12. The method of claim 11, wherein the predetermined current level is determined based on at least one of a voltage of a power source or a temperature associated with the engine system.

13. The method of claim 9, wherein the adjusting is further based on at least one of a battery voltage of the engine system, an engine speed of the engine system, or a desired start of pressurization timing of the fuel injector.

14. The method of claim 9, wherein the valve is a spill valve and the actuated position of the spill valve is a closed position that allows a pressure of fuel within the fuel injector to increase.

15. A fuel injection control system, comprising:

at least one power source;

a fuel injector including a spill valve and a control valve, the spill valve being biased towards an open position and including a spill valve solenoid, the control valve being actuated separately from the spill valve; and a controller configured to:

apply a pull-in current to close the spill valve of the fuel injector;

detect a timing at which the spill valve closes; and adjust at least one of an amplitude of a pull-in current, a duration of the pull-in current, or a timing of a start of an application of the pull-in current based on the detected timing of the closing of the spill valve.

16. The fuel injection control system of claim 15, wherein the controller is configured to perform the adjustment based on at least one of a battery voltage for applying current to the spill valve, an engine speed of an internal combustion engine, or a desired start of pressurization timing of the fuel injector.

17. The fuel injection control system of claim 15, wherein the controller is configured to associate the detected timing of the closing of the spill valve with at least one engine condition including a battery voltage of the engine system, an engine speed of the engine system, or a desired start of pressurization timing of the fuel injector.

18. The fuel injection control system of claim 17, wherein the controller is configured to store a value indicative of the closing of the spill valve and the associated engine condition.

19. The fuel injection control system of claim 15, wherein the controller is configured to generate an indicator based on an error between the detected time at which the spill valve closes and an expected timing at which the spill valve closes.

20. The fuel injection control system of claim 19, wherein the controller is configured to detect the time at which the spill valve closes based on a drop in current followed by an increase in current in the spill valve solenoid while supplying energy to the spill valve solenoid by a battery.

* * * * *